US007195138B2

(12) United States Patent
Foster et al.

(10) Patent No.: US 7,195,138 B2
(45) Date of Patent: Mar. 27, 2007

(54) CONTAINER CLOSURE WITH BIASED CLOSED VALVE

(75) Inventors: Donald D. Foster, St. Charles, MO (US); Philip L. Nelson, Wildwood, MO (US)

(73) Assignee: Continental AFA Dispensing Company, St. Peters, MO (US)

( * ) Notice: Subject to any disclaimer, the term of this patent is extended or adjusted under 35 U.S.C. 154(b) by 0 days.

(21) Appl. No.: 11/211,348

(22) Filed: Aug. 25, 2005

(65) Prior Publication Data

US 2007/0045356 A1 Mar. 1, 2007

(51) Int. Cl.
*B67D 5/06* (2006.01)

(52) U.S. Cl. ..... 222/494
(58) Field of Classification Search ..... 222/494
See application file for complete search history.

(56) References Cited

U.S. PATENT DOCUMENTS

| | | | | |
|---|---|---|---|---|
| 6,223,956 | B1 * | 5/2001 | Albers | 222/494 |
| 6,367,668 | B1 * | 4/2002 | Schwanenberg | 222/490 |
| 6,378,742 | B1 * | 4/2002 | Rohr et al. | 222/494 |
| 6,749,092 | B2 * | 6/2004 | Olechowski et al. | 222/494 |
| 2004/0178230 | A1 * | 9/2004 | Feierabend | 222/494 |

* cited by examiner

*Primary Examiner*—Philippe Derakshani
(74) *Attorney, Agent, or Firm*—Thompson Coburn LLP

(57) ABSTRACT

A closure is removably attachable to a container and comprises a dispensing orifice and a valve element that is biased closed over the orifice. By inverting the container so that a liquid contents of the container exerts pressure on the valve element, or by squeezing the container causing the liquid contents to exert pressure on the valve element, the valve element opens the dispensing orifice allowing the liquid contents to be dispensed from the container. On removing the pressure from the valve element, the valve element resiliently closes the dispensing orifice.

23 Claims, 5 Drawing Sheets

CONTAINER CLOSURE WITH BIASED CLOSED VALVE

BACKGROUND OF THE INVENTION (1) Field of the Invention

The present invention pertains to a container closure for a container that is inverted and/or manually squeezed to dispense the contents of the container through an orifice of the closure. Specifically, the present invention pertains to a closure that is removably attachable to the container and comprises a dispensing orifice and a valve element that is biased closed over the orifice. By inverting the container so that a liquid contents of the container exerts pressure on the valve element, or by squeezing the container causing the liquid contents to exert pressure on the valve element, the valve element opens the dispensing orifice allowing the liquid contents to be dispensed from the container. On removing the pressure from the valve element, the valve element resiliently closes the dispensing orifice.

(2) Description of the Related Art

Containers that are inverted and/or squeezed to dispense the liquid contents of the container are employed in dispensing a wide variety of products. Dispensers of this type are commonly used in dispensing household products, for example food condiments such as ketchup, mustard, and pancake syrup, and are also used in dispensing other products such as liquid soaps and glues. The container is typically flexible and resilient, which allows the container to be manually squeezed to exert a pressure on the contents of the container that forces a portion of the contents through a dispensing orifice of the container.

In order to keep the contents of the container fresh in the case of food condiments, or to keep the contents from drying out in the case of soap or glue, the container dispensing orifice is often provided with a closure. A simple example of a prior art closure is a cap that is screw threaded on a threaded neck of the container. Another example is a cap that is snapped onto the container covering over a dispensing spout. Each of these basic types of prior art closures are disadvantaged in that they require some manual movement of the cap to close the container dispensing orifice. When screw threading the cap on the container, it is possible to not completely screw thread the cap on the container. This could result in the cap falling off of the container, or could result in an incomplete seal of the container dispensing orifice. In a like manner, in snapping the cap on the container, it is possible for the cap to not be properly attached to the container. This also could result in the cap falling off of the container, or the cap not sealing the container dispensing orifice. In both situations, the container dispensing orifice is left unsealed, which could result in the spoiling of the container contents or the drying out of the container contents.

SUMMARY OF THE INVENTION

The container closure of the present invention overcomes the above described disadvantages associated with prior art container closures by providing a closure that automatically opens when the container is inverted and/or manually squeezed, and automatically closes when the container is positioned uprightly and there is no squeezing pressure on the container.

The container closure of the invention has a simple construction that is comprised of three component parts. Each of the component parts is constructed of a plastic, with the plastic of one of the component parts being more flexible and more resilient than the plastic of the other component parts. The three component parts of the container closure include a base, a valve retainer, and a valve element.

The closure base is constructed similar to a typical cap that is screw threaded on the screw threaded neck of a container. The base has a generally cylindrical configuration with a cylindrical side wall and a circular exterior surface and a circular interior surface at opposite ends of the side wall. A dispensing orifice extends through the base between the interior and exterior surfaces. A cylindrical cavity is recessed into the base interior surface. A cylindrical wall on the base interior surface surrounds the cavity. A portion of the wall has internal screw threading that removable attaches the closure onto the external screw threading that surrounds an opening of a complementary container. The cylindrical wall also surrounds and is concentric with the dispensing orifice of the base. Thus, attaching the base interior surface to the container aligns the base orifice with the container opening.

A lid is attached to the base by a living hinge. The hinge allows the lid to be moved between a closed position where the lid is positioned over the base exterior surface and over the dispensing orifice, and an opened position where the lid is displaced from the base exterior surface and the dispensing orifice.

The valve retainer has a cylindrical peripheral surface that engages with the cylindrical interior wall of the base in attaching the valve retainer to the base. At least one fluid passage hole extends through the valve retainer. The hole is positioned inwardly from the valve retainer peripheral surface.

The valve element is mounted on the valve retainer in a position between the base interior surface and the valve retainer. The valve element is circular and has a dome shape with opposite convex and concave surfaces. The convex surface of the valve element opposes the base interior surface and the orifice, and the concave surface of the valve element opposes the valve retainer. An outer annular flange of the valve element is attached to the valve retainer. The valve element flange has at least one hole that aligns with the hole through the valve retainer. The attachment of the valve element annular flange on the valve retainer positions a central portion of the valve element convex surface in engagement over the dispensing orifice.

The resiliency and flexibility of the valve element allows the valve element to move between closed and opened positions relative to the base and the valve retainer. The resiliency of the valve element biases the valve element to the closed position where the convex surface of the valve element engages over and closes the dispensing orifice. When the container closure is attached to a liquid container and the pressure of the liquid in the container is increased, for example by inverting the container and/or squeezing the container, the liquid flows through the retainer hole to the valve element convex surface and the pressure of the liquid causes the valve element to flex away from the dispensing orifice and opens the orifice.

BRIEF DESCRIPTION OF THE DRAWING FIGURES

Further features of the invention are set forth in the following detailed description of the preferred embodiment of the invention and in the drawing figures wherein.

DETAILED DESCRIPTION OF THE PREFERRED EMBODIMENT

Figure 1:
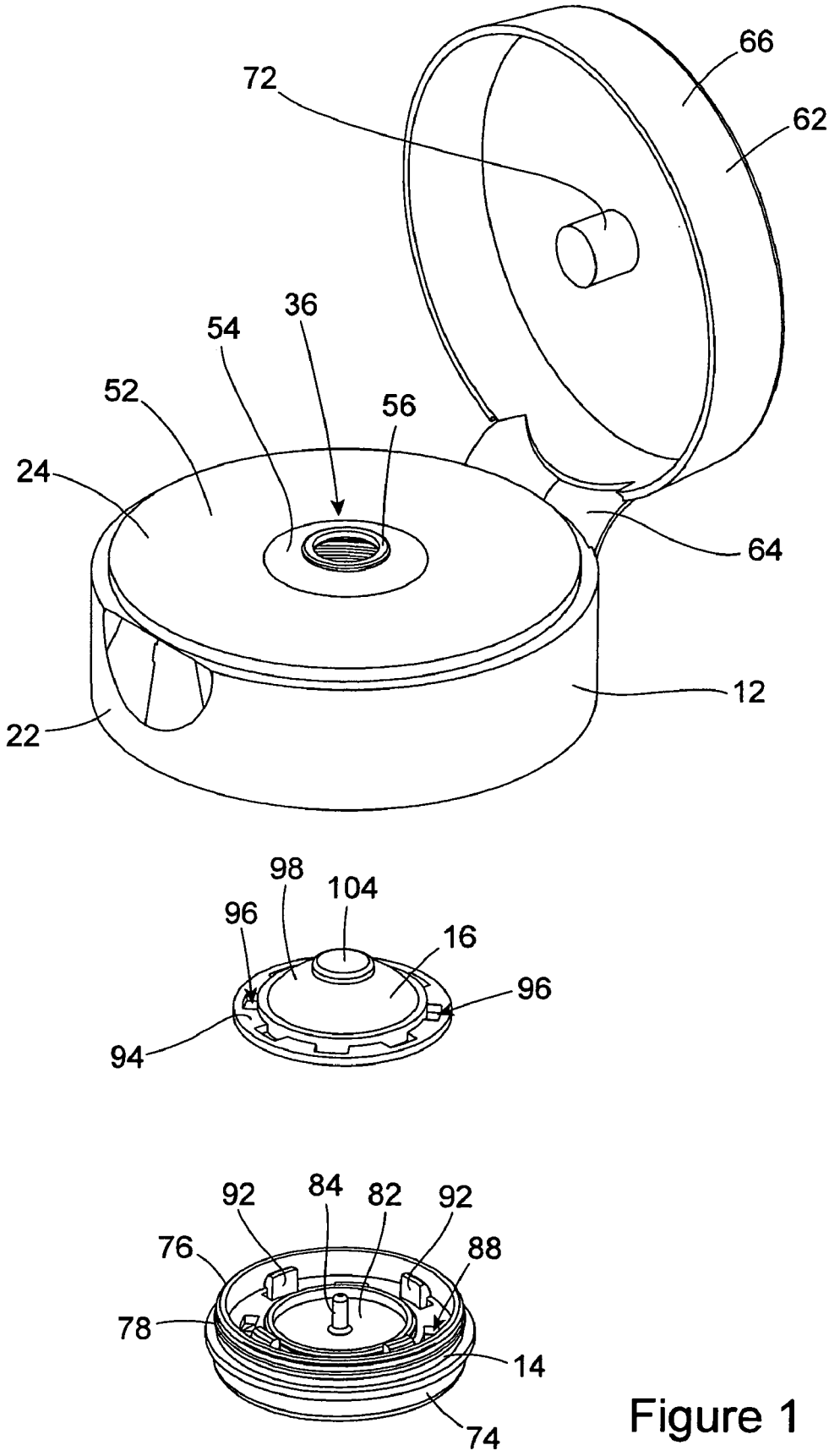
FIG. 1 is an exploded view of the component parts of the container closure.

The container closure of the invention has a simplified, inexpensive construction that is comprised of only three component parts. The closure is designed to be removably attachable to a container by being screw threaded on a threaded neck of the container that surrounds the dispensing opening of the container. Alternatively, the closure could be snap fit to the container over the container dispenser opening, or attached to the container by some other method, for example by a bayonet fitment. Although a screw threaded connector will be described on the container closure, the container closure should not be interpreted as being limited to this particular type of connector.

As stated earlier, in the preferred embodiment of the invention, each of the component parts of the container closure is constructed of a plastic material. The three basic component parts of the container closure include a closure base 12, a valve retainer 14, and a valve element 16. The plastic material of the valve element 16 is more flexible and more resilient than the plastic material of the base 12 and valve retainer 14.

The closure base 12 has a similar construction to a typical cap that is screw threaded on the screw threaded neck of a container. The base 12 has a generally cylindrical configuration with a cylindrical side wall 22 and a generally circular exterior surface 24 and a generally circular interior surface 26 at the opposite ends of the side wall. The interior surface 26 is designed to be removably attachable to a separate liquid container over the dispensing opening of the container. To accomplish this, a cylindrical wall 28 having a center axis 32 is formed on the base interior surface 26. The cylindrical wall 28 surrounds a cavity 34 that extends upwardly through the base and communicates with a dispensing orifice 36 of the base. The cylindrical wall 28 has a first portion 38 that is provided with internal screw threading 42. The screw threading 42 is designed to removably attach the container closure base 12 to a separate liquid container. The cylindrical wall interior also has a second portion 44 that is provided with an internal annular groove 46 that is designed to enable attachment of the valve retainer 14 to the base 12, as will be explained. A conical, annular surface 48 is provided at the end of the cavity 34. The conical, annular surface 48 surrounds the dispensing orifice 36.

The base exterior surface 24 has a flat, annular portion 52 that extends inwardly from the base side wall 22 toward the dispensing orifice 36. As the flat annular surface 52 extends toward the orifice 36 it merges into an annular conical portion 54 of the exterior surface 24. This conical portion 54 of the surface extends outwardly from the flat annular surface portion 52 to an annular lip 56 that surrounds the dispenser orifice 36.

A lid 62 is connected to the base 12 by an integral, living hinge 64. In alternate embodiments of the invention, the lid 62 could be separate from the base 12. The lid 62 has a cylindrical side wall 66 that is connected to the hinge 64. A circular wall 68 of the lid extends inwardly from the side wall 66 toward a center, cylindrical protrusion 72 on the lid. The hinge 64 allows the lid 62 to move between a closed position over the dispensing orifice 36 shown in FIGS. 3 and 4, to an opened position where the lid 62 is displaced from the base exterior surface 24 and the dispensing orifice 36 shown in FIGS. 1, 2, and 5. The protrusion 72 is dimensioned to engage inside the dispensing orifice 36 sealing the orifice closed when the lid is moved to its closed position shown in FIGS. 4 and 5.

Figure 5:
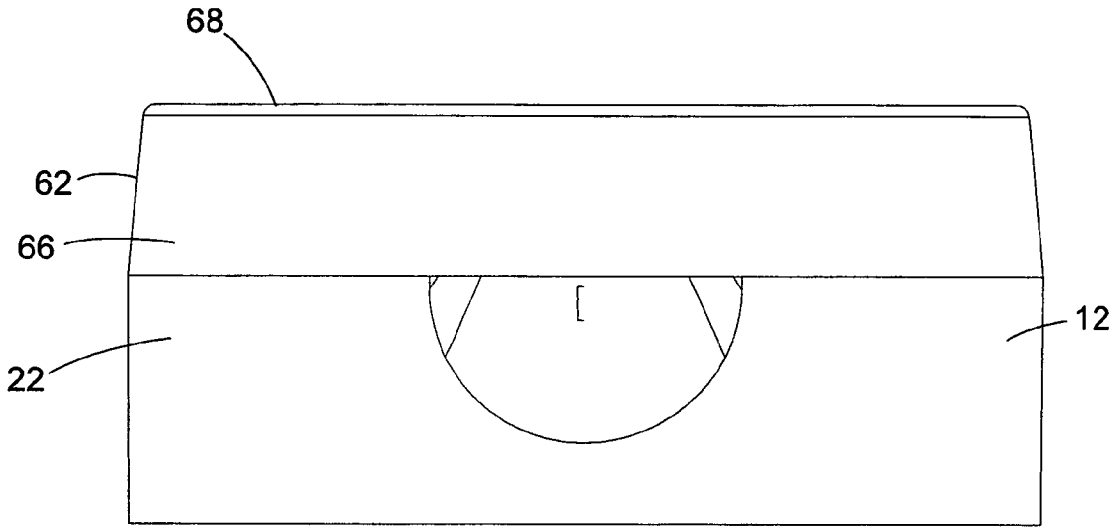

The valve retainer 14 has a cylindrical wall 74 with a peripheral surface portion 76 that is dimensioned to engage inside the second portion 44 of the base cylindrical wall 28 in attaching the valve retainer 14 to the base 12. An annular rib 78 is provided on the valve retainer wall 74. The rib 78 engages in the annular groove 46 of the base cylindrical wall 28 in securely attaching the valve retainer 14 to the base 12. A flat, circular platform 82 extends across the valve retainer cylindrical wall 74. A center post 84 projects upwardly from the top surface of the platform 82, and an annular rim 86 projects upwardly from the platform and extends around the post. A plurality of liquid passage holes 88 extend through the valve retainer platform 82. The holes 88 are spatially arranged around the platform 82, as seen in FIG. 5. Hook shape flanges 92 project upwardly from the platform 82 adjacent every other hole 88 through the platform.

Figure 2:
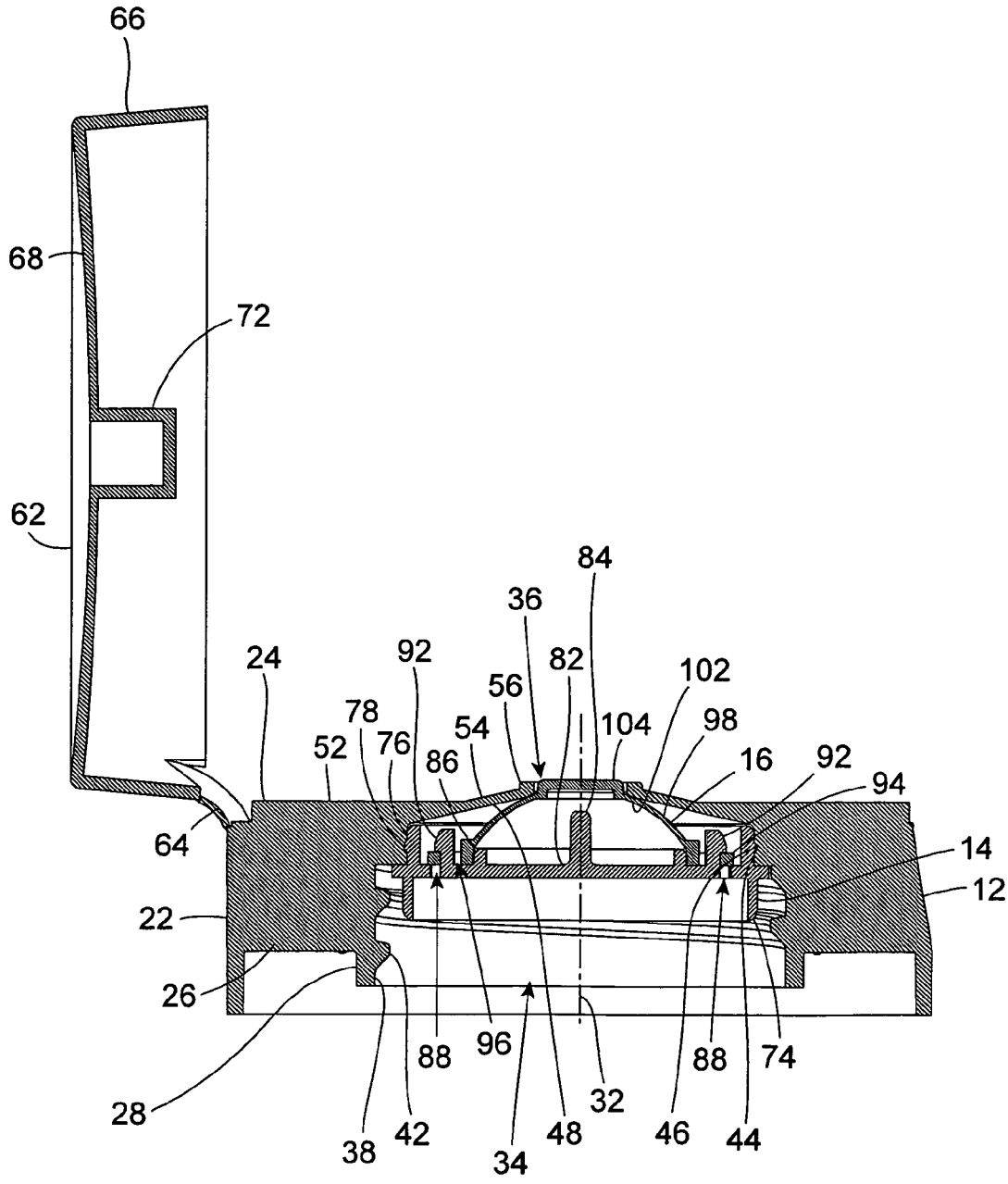
FIG. 2 is a side elevation view, in section, showing the container closure of the invention with the closure lid in its opened position.
Figure 3:
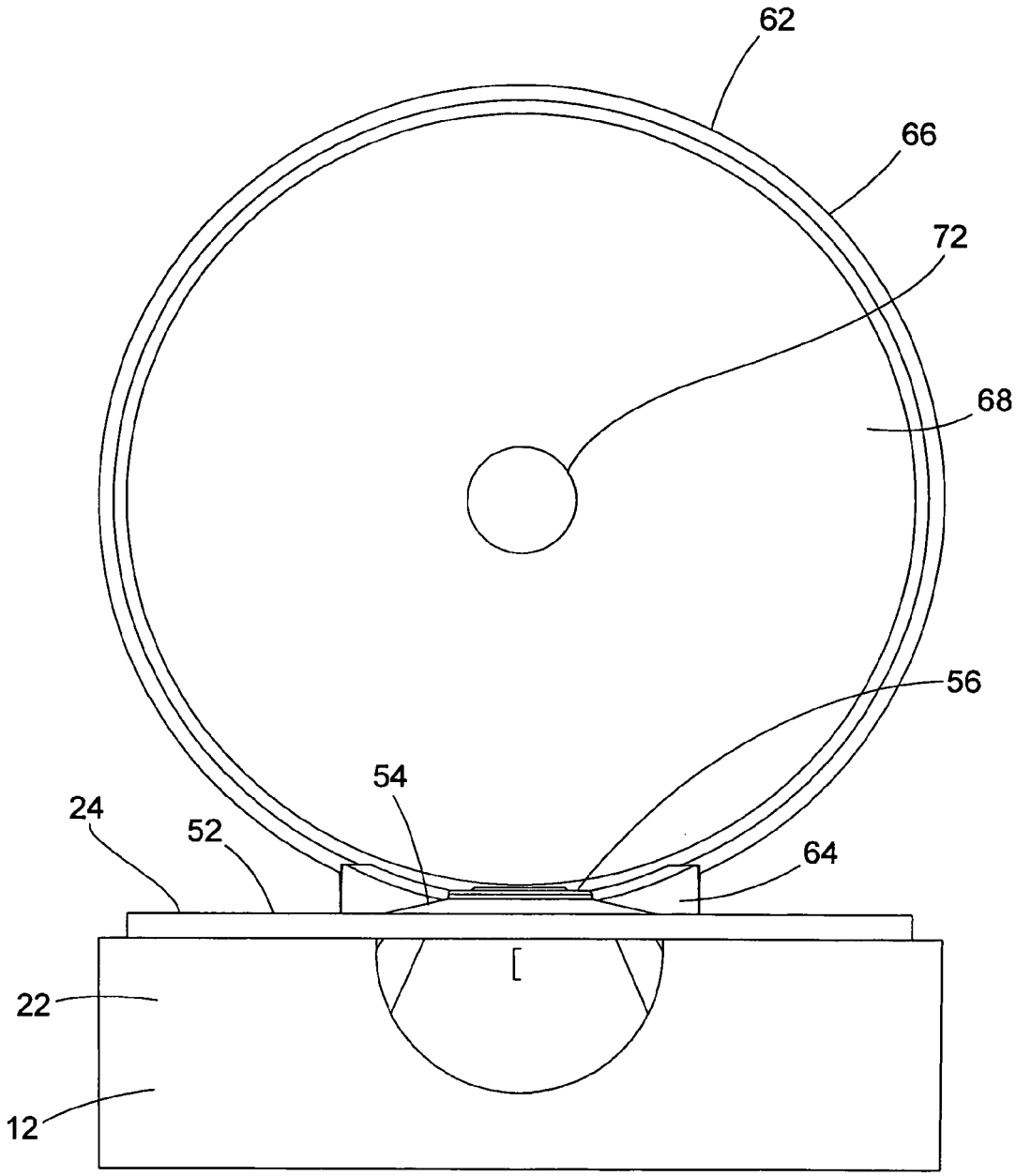
FIG. 3 is a front elevation view of the container closure shown in FIG. 2.
Figure 4:
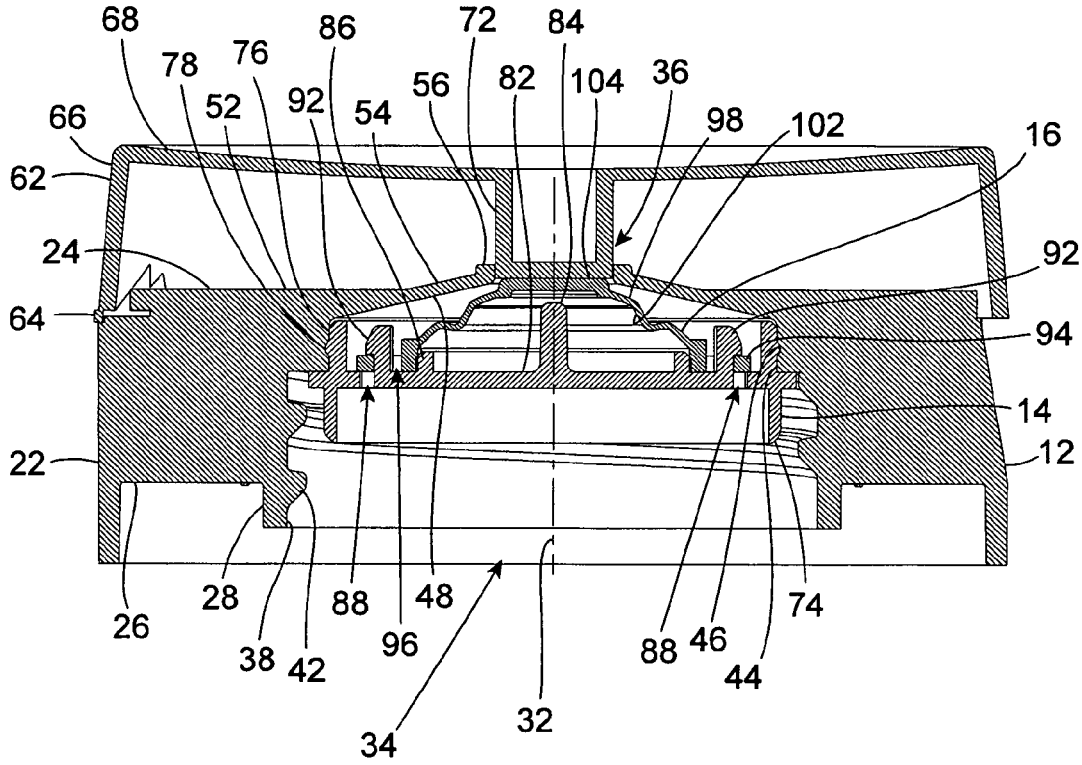
FIG. 4 is an elevation view, in section, showing the container closure with the lid in its closed position; and, FIG. 5 is a front elevation view of the container closure as shown in FIG. 4.

The valve element 16 has a circular, disc shape with a flat annular flange 94 that extends around the outer periphery of the valve element. A plurality of holes 96 pass through the valve element flange. The number of valve element holes 96 corresponds to the number of valve retainer holes 88. In addition, the positions of the valve element holes 96 correspond to the positions of the valve retainer holes 88. As seen in FIGS. 2 and 4, the valve retainer flanges 92 extend upwardly through every other valve element hole 96 and attach the valve element 16 to the valve retainer 14. The valve retainer holes 88 that are positioned between adjacent flanges 92 align with valve element holes 96 and together they define a fluid passageway through the valve retainer 14 and the valve element annular flange 94.

The valve has a dome shape with a convex exterior surface 98 and an opposite concave interior surface 102 inside the valve element annular flange 94. The concave surface 102 engages around the valve retainer rim 86 and seals the concave surface 102 from the fluid passageways defined by the aligned valve retainer holes 88 and valve element holes 96. The valve element convex surface 98 extends upwardly from the annular flange 94 to a circular protrusion 104 at the center of the convex surface. The circular protrusion 104 is dimensioned to fit inside the dispensing orifice 36 of the base.

The resiliency and the flexibility of the valve element 16 allows the valve to move between closed and opened positions relative to the base 12 and the valve retainer 16. FIG. 2 shows the valve element 14 in its closed position with the lid 62 being moved to its opened position relative to the base 12. The resiliency of the dome shaped portion of the valve element 16 positions the convex surface 98 against the conical annular surface portion 48 of the base interior surface 26, and positions the valve element protrusion 104 in the dispensing orifice 36, sealing closed the orifice.

When the closure base 12 is attached to a liquid container and the container is inverted and/or a squeezing pressure is exerted on the container, liquid passes through the dispensing opening of the container and through the liquid passageway defined by the aligned valve retainer holes 88 and valve element holes 96. This liquid under pressure enters the area between the valve element concave surface 102 and the conical annular surface portion 48 of the base interior surface 26. The fluid pressure acts against the valve element 16, causing the valve element to resiliently flex away from the conical annular surface portion 48 of the base interior surface 26 and causing the valve element protrusion 104 to be displaced from the dispensing orifice 36, opening the orifice. This allows the liquid to be dispensed from the liquid container through the dispensing orifice 36. When the liquid pressure is removed from the concave surface 102 of the valve element 16, the resiliency of the valve element pushes the concave surface 102 back into engagement with the conical annular surface portion 48 of the base interior surface 26 and positions the valve element protrusion 104 in the dispensing orifice 36, again sealing closed the orifice. To further seal closed the orifice, the lid 62 can be attached over the base exterior surface 24 positioning the lid cylindrical protrusion 72 in the base dispensing orifice 36.

Although the container closure of the invention has been described above by reference to a single embodiment, it should be understood that modifications and variations could be made to the dispenser without departing from the intended scope of the invention defined by the following claims.

The invention claimed is:

1. A container closure that is attachable to a container to cover over an opening of the container, the container closure comprising:

a base having opposite interior and exterior surfaces and an orifice between the base interior and exterior surfaces, the base interior surface being attachable to the container with the base orifice aligned with the container opening;

a valve retainer attached to the base interior surface around the base orifice; and, a valve element positioned between the base interior surface and the valve retainer, the valve element being movable relative to both the base and the valve retainer between a closed position and an opened position where in the closed position the valve element engages with the base interior surface and extends over and closes communication through the base orifice and in the opened position the valve element is displaced away from the base interior surface and opens the base orifice, and the valve element being biased to the closed position.

2. The container closure of claim 1, further comprising:

the valve element being positioned between the base interior surface and the valve retainer in both the closed and opened positions of the valve element.

3. The container closure of claim 1, further comprising:

the base having a cylindrical interior wall surrounding a cavity in the base interior surface; and, the valve retainer is positioned inside the cavity and engages with the interior wall in attaching the valve retainer to the base.

4. The container closure of claim 1, further comprising:

the base having a wall that surrounds the orifice; and, the valve retainer engaging with the base wall in attaching the valve retainer to the base.

5. The container closure of claim 4, further comprising:

the valve retainer having a peripheral surface that engages with the base wall in attaching the valve retainer to the base; and, the valve retainer having at least one hole through the valve retainer, the hole being spaced from the valve retainer peripheral surface.

6. A container closure that is attachable to a container to cover over an opening of the container, the container closure comprising:

a base having opposite interior and exterior surfaces and an orifice passing through the base interior and exterior surfaces, the base interior surface being attachable to the container with the base orifice aligned with the container opening;

a valve retainer attached to the base interior surface around the base orifice; and, a valve element positioned between the base interior surface and the valve retainer, the valve element being movable relative to both the base and the valve retainer between a closed position and an opened position where in the closed position the valve element engages over and closes the base orifice and in the opened position the valve element is displaced from and opens the base orifice, and the valve element being biased to the closed position; and, the valve retainer hole being positioned between the valve retainer peripheral surface and the valve element.

7. A container closure that is attachable to a container to cover over an opening of the container, the container closure comprising:

a base having opposite interior and exterior surfaces and a peripheral surface extending around the interior and exterior surfaces, a cylindrical wall on the base interior surface, and an orifice through the base interior and exterior surfaces positioned inside the cylindrical wall of the base, the base interior surface being attachable to the container with the base orifice aligned with the container opening;

a valve retainer having a peripheral surface engaging with the base cylindrical wall and attaching the valve retainer to the base interior surface, the valve retainer having at least one hole through the valve retainer;

a valve element positioned between the base interior surface and the valve retainer, the valve element having opposite exterior and interior surfaces with the valve element interior surface engaging with the valve retainer and with the valve retainer sealing over a portion of the valve element interior surface, the valve element being movable relative to both the base and the valve retainer between a closed position and an opened position where in the closed position the valve element engages over and closes communication through the base orifice and in the opened position the valve element is displaced from and opens the base orifice, the valve element being biased toward the closed position.

8. The container closure of claim 7, further comprising:

a lid connected to the base for movement between closed and opened positions of the lid relative to the base where in the closed position the lid covers the base orifice and in the opened position the lid is displaced from the base orifice.

9. The container closure of claim 7, further comprising:

a cavity recessed into the base interior surface;

the base cylindrical wall extending around the cavity; and, the valve retainer and the valve element being positioned in the cavity.

10. A container closure that is attachable to a container to cover over an opening of the container, the container closure comprising:

a base having opposite interior and exterior surfaces and an orifice passing through the base interior and exterior surfaces, the base interior surface being attachable to the container with the base orifice aligned with the container opening; and, a valve element attached to the base adjacent the base interior surface, the valve element having a dome shape with opposite convex and concave surfaces, the valve element convex surface opposing the base orifice, and the valve element being flexible allowing the valve element convex surface to move relative to the base between a closed position and an opened position where in the closed position the valve element convex surface engages over and closes the base orifice and in the opened position the valve element convex surface is displaced from and opens the base orifice, and the valve element dome shape biasing the valve element convex surface toward the closed position.

11. The container closure of claim 10, further comprising:

the base having a cavity in the base interior surface with a cylindrical wall surrounding the cavity and the orifice; and, the valve element being positioned inside the cavity.

12. The container closure of claim 10, further comprising:

the base having a cylindrical wall that surrounds the orifice and extends around the valve element.

13. The container closure of claim 10, further comprising:

the valve element concave surface being sealed from the container opening and the valve element convex surface communicating with the container opening when the base interior surface is attached to the container.

14. A container closure that is attachable to a container to cover over an opening of the container, the container closure comprising:

a base having opposite interior and exterior surfaces and a peripheral surface extending around the interior and exterior surfaces, a cylindrical wall on the base interior surface, and an orifice through the base interior and exterior surfaces positioned inside the cylindrical wall of the base, the base interior surface being attachable to the container with the base orifice aligned with the container opening;

a valve element attached to the base positioned inside the base cylindrical wall and adjacent the base orifice, the valve element having a dome shape with a convex surface opposing the base orifice and an opposite concave surface, the valve element being flexible allowing the valve element convex surface to move relative to the base between a closed position where the valve element convex surface engages over and closes the orifice, and an opened position where the valve element convex surface is displaced from and opens the orifice, the valve element dome shape biasing the valve convex surface toward the closed position, the valve element concave surface being sealed from the container opening and the valve element convex surface communicating with the container opening when the base interior surface is attached to the container.

15. The container closure of claim 14, further comprising:

the base having a cavity in the base interior surface with a cylindrical wall surrounding the cavity and the orifice; and, the valve element being positioned inside the cavity.

16. The container closure of claim 14, further comprising:

the base having a cylindrical wall that surrounds the orifice and extends around the valve element.

17. A container closure that is attachable to a container to cover over an opening of the container, the container closure comprising:

a base having opposite interior and exterior surfaces and an orifice passing through the base interior and exterior surfaces, the base interior surface being attachable to the container with the base orifice aligned with the container opening; and, a valve element attached to the base adjacent the base interior surface, the valve element having a circular shape with opposite interior and exterior surfaces, the valve element exterior surface opposing the base orifice and having a protrusion on the exterior surface that is shaped to fit inside the base orifice, and the valve element being flexible allowing the valve element exterior surface to move relative to the base between a closed position and an opened position where in the closed position the valve element exterior surface engages over the orifice and the valve element protrusion extends into the orifice closing the orifice, and in the opened position the valve element exterior surface is displaced from the orifice and the valve element protrusion is removed from the orifice opening the orifice, and the valve element being biased toward the closed position.

18. The container closure of claim 17, further comprising:

the base having a cavity in the base interior surface with a cylindrical wall surrounding the cavity and the orifice; and, the valve element being positioned inside the cavity.

19. The container closure of claim 17, further comprising:

the base having a cylindrical wall that surrounds the orifice and extends around the valve element.

20. The container closure of claim 17, further comprising:

the valve element interior surface being sealed from the container opening and the valve element exterior surface communicating with the container opening when the base interior surface is attached to the container.

21. A container closure that is attachable to a container to cover over an opening of the container, the container closure comprising:

a base having opposite interior and exterior surfaces and a peripheral surface extending around the interior and exterior surfaces, a cylindrical wall on the base interior surface, and an orifice through the base interior and exterior surfaces positioned inside the cylindrical wall of the base, the base interior surface being attachable to the container with the base orifice aligned with the container opening;

a valve element attached to the base positioned inside the base cylindrical wall and adjacent the base orifice, the valve element having a circular shape with opposite exterior and interior surfaces, the valve element exterior surface opposing the base orifice and having a protrusion on the exterior surface shaped to fit inside the base orifice, and the valve element being flexible allowing the valve element exterior surface to move relative to the base between a closed position and an opened position where in the closed position the valve element exterior surface engages over the orifice and the valve element protrusion extends into the orifice closing the orifice, and in the opened position the valve element exterior surface is displaced from the orifice and the valve element protrusion is removed from the orifice opening the orifice, the valve element being biased toward the closed position, the valve element interior surface being sealed from the container opening and the valve element exterior surface communicating with the container opening when the base interior surface is attached to the container.

22. The container closure of claim 21, further comprising:

the base having a cavity in the base interior surface with the cylindrical wall surrounding the cavity and the orifice; and, the valve element being positioned inside the cavity.

23. The container closure of claim 21, further comprising:

a lid that is positionable over the base interior surface to cover over the orifice and is removable from over the base exterior surface to expose the orifice.

* * * * *